US011804652B2

(12) United States Patent
Kozlov et al.

(10) Patent No.: US 11,804,652 B2
(45) Date of Patent: Oct. 31, 2023

(54) ANTENNA HAVING CONTROLLED DIRECTIVITY

(71) Applicant: NOKIA SOLUTIONS AND NETWORKS OY, Espoo (FI)

(72) Inventors: Dmitry Kozlov, Dublin (IE); Senad Bulja, Dublin (IE); Jack Millist, Carcassonne (FR)

(73) Assignee: NOKIA SOLUTIONS AND NETWORKS OY, Espoo (FI)

( * ) Notice: Subject to any disclaimer, the term of this patent is extended or adjusted under 35 U.S.C. 154(b) by 0 days.

(21) Appl. No.: 16/910,299

(22) Filed: Jun. 24, 2020

(65) Prior Publication Data

US 2020/0411988 A1 Dec. 31, 2020

(30) Foreign Application Priority Data

Jun. 25, 2019 (EP) ..... 19182123

(51) Int. Cl.

| | |
|---|---|
| ***H01Q 3/24*** | (2006.01) |
| ***H01Q 19/06*** | (2006.01) |
| ***H01Q 21/00*** | (2006.01) |
| ***H01Q 21/06*** | (2006.01) |

(52) U.S. Cl.

CPC ..... *H01Q 3/245* (2013.01); *H01Q 19/06* (2013.01); *H01Q 21/0006* (2013.01); *H01Q 21/061* (2013.01)

(58) Field of Classification Search

CPC ..... H01Q 3/245; H01Q 3/46; H01Q 5/50; H01Q 19/06; H01Q 21/006; H01Q 21/061

See application file for complete search history.

(56) References Cited

U.S. PATENT DOCUMENTS

| | | | | |
|---|---|---|---|---|
| 5,977,904 | A * | 11/1999 | Mizuno | H01Q 1/3233 342/70 |
| 9,716,319 | B2 | 7/2017 | Caratelli et al. | |
| 10,116,051 | B2 | 10/2018 | Scarborough et al. | |
| 10,203,452 | B2 | 2/2019 | Sun et al. | |
| 2014/0077995 | A1* | 3/2014 | Artemenko | H04B 7/00 342/367 |
| 2015/0138018 | A1 | 5/2015 | Yamamoto et al. | |
| 2015/0200452 | A1* | 7/2015 | Oh | H01Q 19/062 343/754 |
| 2015/0341098 | A1 | 11/2015 | Angeletti et al. | |

(Continued)

FOREIGN PATENT DOCUMENTS

| | | | |
|---|---|---|---|
| EP | 0 867 972 | B1 | 9/1998 |
| WO | WO 2016/075847 | A1 | 5/2016 |

OTHER PUBLICATIONS

Office Action for European Application No. 19182123.0 dated Jan. 23, 2023, 6 pages.

(Continued)

*Primary Examiner* — Graham P Smith
*Assistant Examiner* — Amal Patel
(74) *Attorney, Agent, or Firm* — ALSTON & BIRD LLP

(57) ABSTRACT

An apparatus including a dielectric lens and a feeding array having feeding elements at different positions. The apparatus also including circuitry configured to simultaneously operate one feeding element of a first group of feeding elements and one feeding element of a second group of feeding elements.

20 Claims, 4 Drawing Sheets

(56) References Cited

U.S. PATENT DOCUMENTS

| | | | | |
|---|---|---|---|---|
| 2016/0013551 | A1* | 1/2016 | Moon | H01Q 3/267 342/368 |
| 2017/0062944 | A1 | 3/2017 | Zimmerman et al. | |
| 2018/0269576 | A1* | 9/2018 | Scarborough | H01Q 3/245 |

OTHER PUBLICATIONS

Extended European Search Report for European Application No. 19182123.0 dated Dec. 20, 2019, 11 pages.

Mumcu et al., "Mm-Wave Beam Steering Antenna with Reduced Hardware Complexity Using Lens Antenna Subarrays", IEEE Antennas and Wireless Propagation Letters, vol. 17, No. 9, (Sep. 2018), pp. 1603-1607.

* cited by examiner

ANTENNA HAVING CONTROLLED DIRECTIVITY

CROSS-REFERENCE TO RELATED APPLICATIONS

This application claims priority to European Application No. 19182123.0, filed Jun. 25, 2019, the entire contents of which are incorporated herein by reference.

TECHNOLOGICAL FIELD

Embodiments of the present disclosure relate to an antenna having controlled directivity.

BACKGROUND

In some circumstances it is desirable to have an antenna that has controlled directivity and can be controlled to 'point' in any one of multiple different directions. Such an antenna can be used for reception or transmission.

BRIEF SUMMARY

According to various, but not necessarily all, embodiments there is provided an apparatus comprising:

a dielectric lens;

a feeding array comprising feeding elements at different positions; and circuitry configured to simultaneously operate one feeding element of a first group of feeding elements and one feeding element of a second group of feeding elements.

In some but not necessarily all examples, the feeding elements in the first group are arranged as a two-dimensional array in a focal plane of the lens and wherein the feeding elements of the second group are arranged as a two-dimensional array in the focal plane of the lens.

In some but not necessarily all examples, the circuitry is configured such that simultaneous operation of a selected feeding element of a first group of feeding elements and a selected feeding element of a second group of feeding elements creates a selected one of a plurality of possible virtual feeding elements, each having a different virtual position.

In some but not necessarily all examples, each of the plurality of different virtual feeding elements produces an antenna beam in a different specific direction defined by a virtual position of the virtual feeding element.

In some but not necessarily all examples, the dielectric lens has a focal length F and wherein a virtual feeding element or feeding element at a Cartesian co-ordinate position (X, Y) in a focal plane of the lens orients the antenna beam to an angle sin-1(X/F) relative to the x-axis and to an angle sin-1 (Y/F) relative to the y-axis.

In some but not necessarily all examples, the circuitry is configured such that simultaneous operation of a selected feeding element of the first group of feeding elements that is positioned at a Cartesian co-ordinate position (X1, Y1) in a focal plane of the lens and a selected feeding element of the second group of feeding elements that is positioned at a Cartesian co-ordinate position (X2, Y2) in the focal plane of the lens creates a selected virtual feeding element that is positioned at ½(X1+X2, Y1+Y2).

In some but not necessarily all examples, the dielectric lens is shaped to equalize a phase front of an incident field radiated by any one of the plurality of virtual feeding elements.

In some but not necessarily all examples, the feeding elements in the first group are arranged in a different pattern to the feeding elements of the second group.

In some but not necessarily all examples, the feeding elements in the first group are arranged in a first pattern and the feeding elements of the second group are arranged in a second pattern.

In some but not necessarily all examples, the feeding elements do not have even spatial distribution within the first pattern and/or the second pattern. In some but not necessarily all examples, the feeding elements do not have the same spatial distribution within the first pattern and within the second pattern.

In some but not necessarily all examples, the circuitry comprises a first switching network configured to independently select for operation the at least one feeding element of the first group of feeding elements and a second switching network configured to independently select for operation the at least one feeding element of the second group of feeding elements.

In some but not necessarily all examples, the first switching network has a rooted tree architecture comprising, at a root and at internal vertexes of the rooted tree, a first plurality of single-pole multiple terminal switches, wherein each single-pole multiple terminal switch, in a lowest hierarchical level, has a single-pole connected to only one terminal of one single-pole multiple terminal switch in the next higher hierarchical level and each terminal connected to only one feeding element of the first group of feeding elements, wherein each feeding element of the first group of feeding elements is connected to only one terminal of a single-pole multiple terminal switcheach single-pole multiple terminal switch, in other hierarchical levels than the lowest hierarchical level and the highest hierarchical level at the root, has a single-pole connected to only one terminal of one single-pole multiple terminal switch in the next higher hierarchical level; and the highest hierarchical level at the root of the rooted tree architecture, comprises a single-pole multiple terminal switch that has each of its terminals connected to only one single pole of one single-pole multiple terminal switch in the next lower hierarchical level and has its single-pole connected to transfer an information signal.

In some but not necessarily all examples, each of the first plurality of single-pole multiple terminal switches has the same number of terminals.

In some but not necessarily all examples, the rooted tree architecture has H hierarchical levels including the highest hierarchical level and the lowest hierarchical level, wherein each of the first plurality of single-pole multiple terminal switches has M terminals, wherein the first plurality is $(M^H-1)/M-1$ and the first group comprises $M^H$ feeding elements.

In some but not necessarily all examples, each feeding element is configured to produce a highly directive, narrow beam radiation pattern at frequencies above 24 GHz.

In some but not necessarily all examples, radio communication apparatus comprises the apparatus and transmitting and/or receiving circuitry.

According to some but not necessarily all examples there is provided an apparatus comprising:

a lens;

a first plurality of feeding elements arranged to communicate with the lens;

a second plurality of feeding elements arranged to communicate with the lens;

selecting means arranged to couple at least one of: transmitting circuitry and receiving circuitry, simultaneously to at least one feeding element of the first plurality of feeding elements and at least one feeding element of the second plurality of feeding elements.

In some but not necessarily all examples, the first selecting means arranged to couple at least one of: transceiver circuitry, transmitter circuitry and receiver circuitry, to at least one feeding element of the first plurality of feeding elements and second selecting means arranged to couple at least one of: the transceiver circuitry, the transmitter circuitry and the receiver circuitry, to at least one feeding element of the second plurality of feeding elements, wherein the first and second means are arranged to couple simultaneously.

BRIEF DESCRIPTION

Some example embodiments will now be described with reference to the accompanying drawings in which.

DETAILED DESCRIPTION

Figure 1:
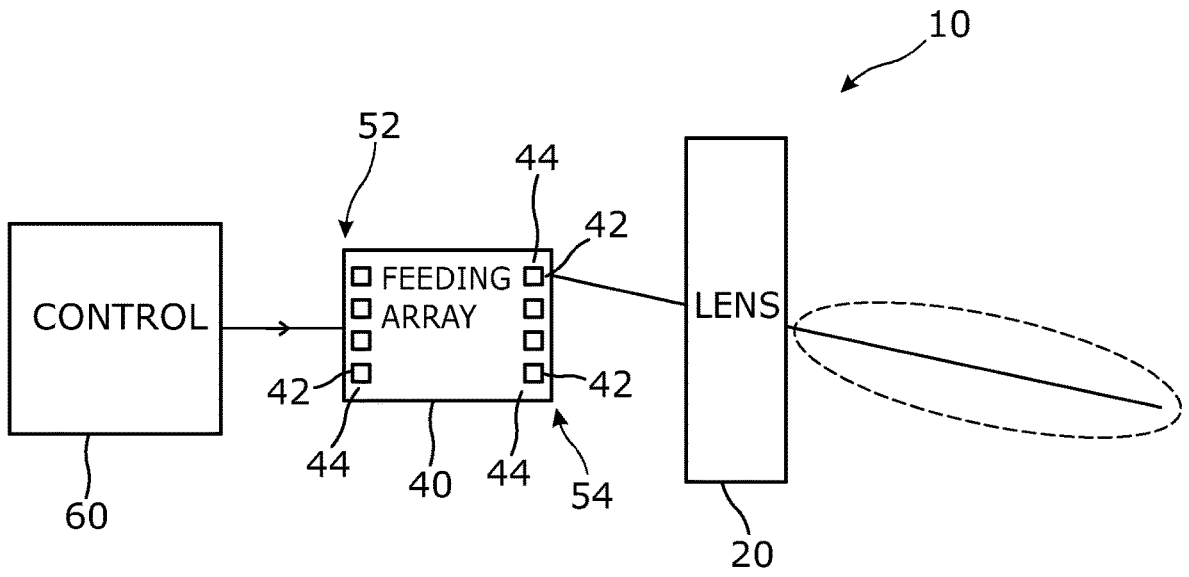
FIG. 1 shows an example embodiment of the subject matter described herein.

FIG. 1 illustrates an example of an apparatus 10 comprising:

a dielectric lens 20; a feeding array 40 comprising feeding elements 42 at different positions 44; and circuitry 60 configured to simultaneously operate one feeding element 42 of a first group 52 of feeding elements 42 and one feeding element 42 of a second group 54 of feeding elements 42.

The apparatus 10 is an antenna that has controllable directivity.

In some but not necessarily all examples, each of the feeding elements 42 is a distinct antenna. For example a patch antenna. For example a horn antenna.

Each of the feeding elements 42 of the feeding array 40 is either in the first group 52 or the second group 56.

Figure 2:
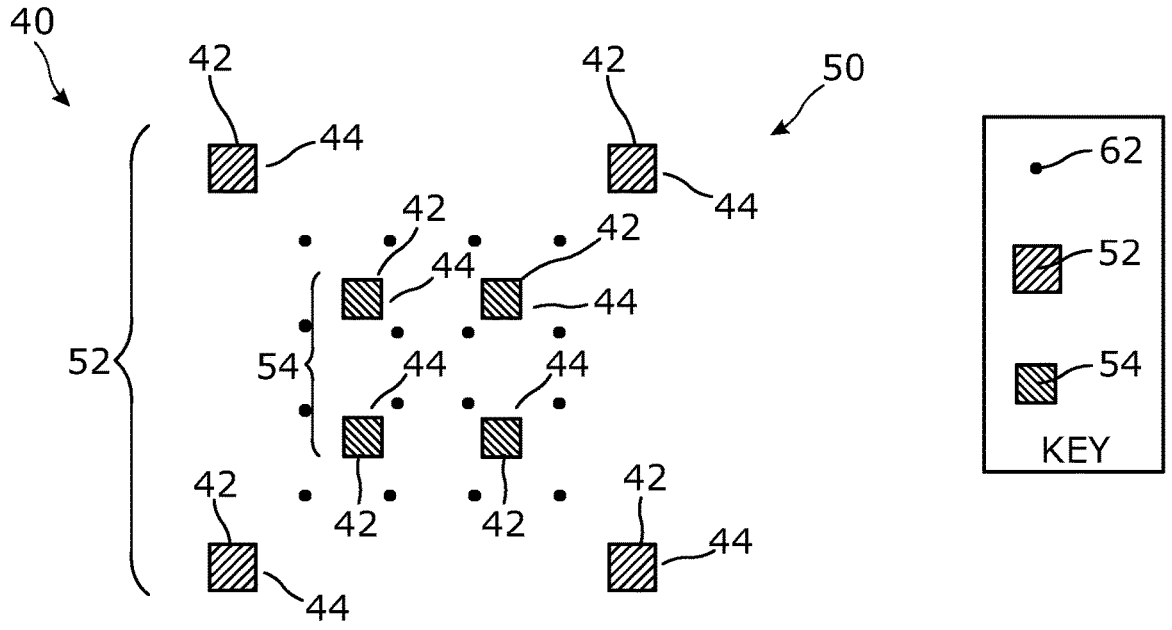
FIG. 2 shows another example embodiment of the subject matter described herein.

In some but not necessarily all examples, for example as illustrated in FIG. 2, the feeding elements 42 in the first group 52 are arranged as a two-dimensional array 50. The feeding elements 42 of the first group 52 of feeding elements 42 have positions 44. In this example, each position 44 of the feeding elements 42 of the first group 52 can be represented as a Cartesian co-ordinate position $p_{ij}^{(1)}=(x_{ij}^{(1)}, y_{ij}^{(1)})$, where i is an index for the x-direction and j is an index for the y-direction.

In some but not necessarily all examples, for example as illustrated in FIG. 2, the feeding elements 42 in the second group 54 are arranged as a two-dimensional array 50. The feeding elements 42 of a second group 54 of feeding elements 42 have positions 44. In this example, each position 44 of the feeding elements 42 of the second group 54 can be represented as a Cartesian co-ordinate position $P_{pq}^{(2)}=(x_{pq}^{(2)}, y_{pq}^{(2)})$, where p is an index for the x-direction and q is an index for the y-direction.

The simultaneous operation of a feeding element 42 of the first group 52 and a feeding element 42 of the second group 54, creates two interfering radiation patterns that interfere constructively in the far-field region.

Figure 4:
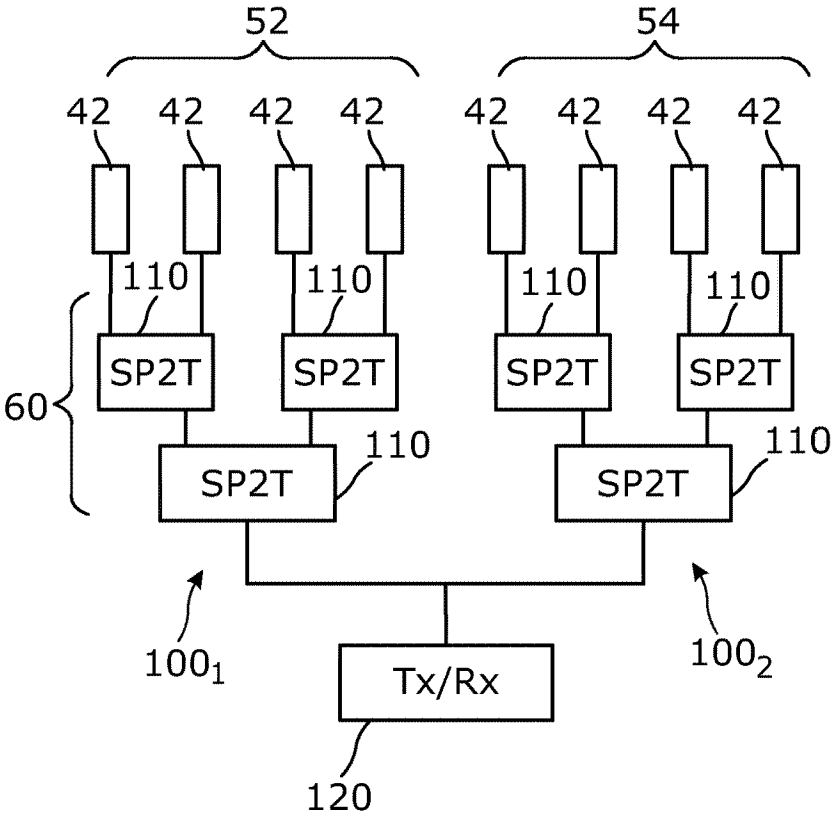
FIG. 4 shows another example embodiment of the subject matter described herein.
Figure 3:
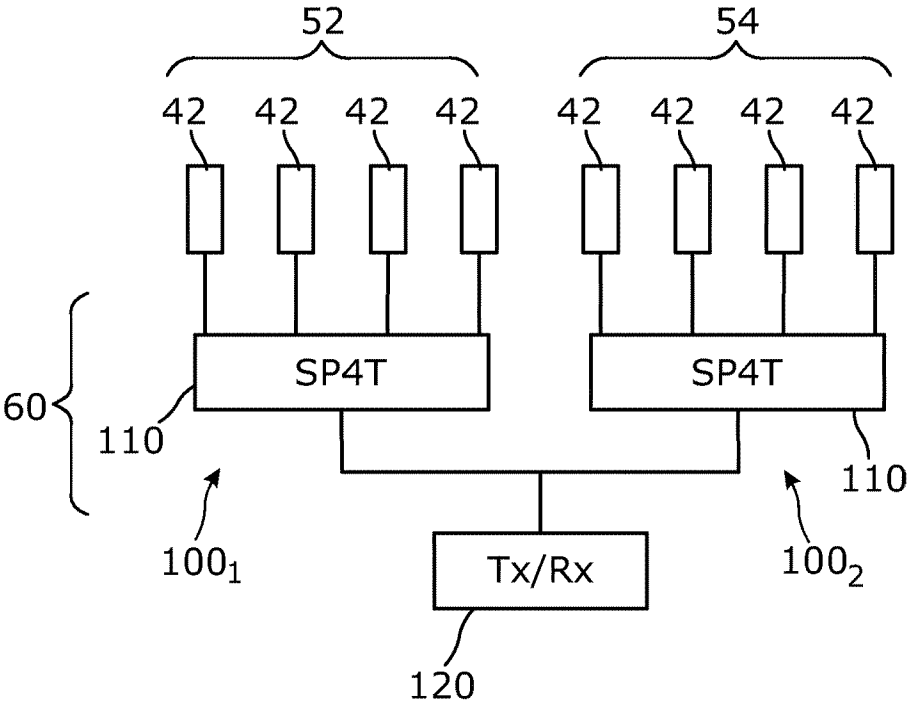
FIG. 3 shows another example embodiment of the subject matter described herein.

In some but not necessarily all examples, for example as illustrated in FIG. 3 or 4, the circuitry 60 comprises a first switching network $\mathbf{100}_1$ configured to independently select for operation one feeding element 42 of the first group 52 of feeding elements and a second switching network $\mathbf{100}_2$ configured to independently select for operation one feeding element 42 of the second group 54 of feeding elements.

In this example, feeding elements 42 are either in the first group 52 or the second group 54. There are no feeding elements 42 in both the first group 52 and the second group 54.

The first switching network $\mathbf{100}_1$ connects a selected feeding element 42 in the first group 52 to circuitry 120 (for transmitting and/or receiving) and the second switching network $\mathbf{100}_2$ simultaneously connects a selected feeding element 42 in the second group 54 to the circuitry 120 (for transmitting and/or receiving).

In FIG. 3, first switching network $\mathbf{100}_1$ comprises a single-pole multiple terminal switch 110 connected to circuitry 120 and the second switching network $\mathbf{100}_2$ comprises a single-pole multiple terminal switch 110 connected to circuitry 120.

In FIG. 4, first switching network $\mathbf{100}_1$ comprises a hierarchical network of single-pole multiple terminal switches 110 connected to circuitry 120 and the second switching network $\mathbf{100}_2$ comprises hierarchical network of single-pole multiple terminal switches 110 connected to circuitry 120.

Figure 5:
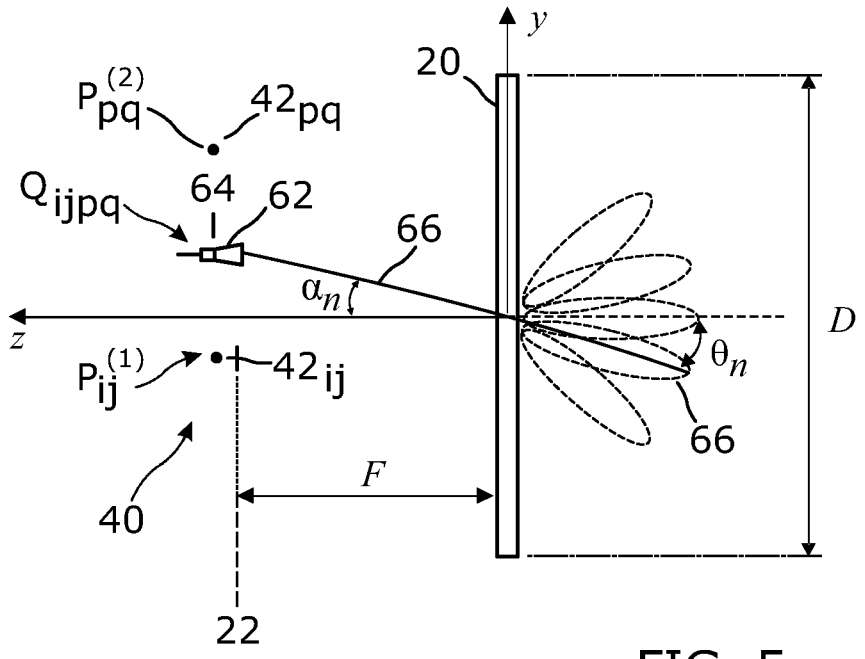
FIG. 5 shows another example embodiment of the subject matter described herein.

The circuitry 60 is configured to simultaneously operate one feeding element 42 of the first group 52 of feeding elements 42 and one feeding element 42 of the second group 54 of feeding elements 42. As illustrated in FIG. 5, this creates one of a plurality of possible virtual feeding elements 62, each having a different virtual position 64.

By simultaneously operating a different pair of feeding elements 42, where one of the pair is from the first group 52 and the other of the pair is from the second group 54, a different virtual feeding elements 62 at a different virtual position 64 is created. Each distinct pair of feeding elements 42 (one from the first group 52 and the other of the pair from the second group 54) creates a different virtual feeding elements 62 at a different virtual position 64.

The virtual feeding elements 62 at a different virtual positions 64 may be arranged in a two dimensional plane for example as a regularly spaced two-dimensional matrix.

The dielectric lens 20 is shaped to equalize a phase front of an incident field radiated by any one of the plurality of virtual feeding elements 62. The dielectric lens 20 has a focal length F.

The virtual feeding elements 62 are positioned within a focal plane 22 of the dielectric lens 20.

In this example, but not necessarily all examples, the array 50 of feeding elements 42 of the first group 52 are positioned within the focal plane 22 and the array 50 of feeding elements 42 of the second group 54 are also positioned within the focal plane 22. Pairing feeding elements 42 of the first group 52 and the second group 54 to produce virtual feeding elements 62, positions the virtual feeding elements 62 within the focal plane 22.

A feeding element 42 at a Cartesian co-ordinate position (X, Y) in the focal plane 22 of the lens 20 orients its antenna beam to an angle $\sin^{-1}(X/F)$ relative to the x-axis and to an angle $\sin^{-1}(Y/F)$ relative to the y-axis.

A virtual feeding element 62 at a Cartesian co-ordinate position (X, Y) in the focal plane 22 of the lens 20 orients its antenna beam to an angle $\sin^{-1}(X/F)$ relative to the x-axis and to an angle $\sin^{-1}(Y/F)$ relative to the y-axis.

Simultaneous operation of a feeding element $\mathbf{42}_{ij}$ of a first group 52 of feeding elements 42 that is positioned at a Cartesian co-ordinate position $P_{ij}^{(1)}=(x_{ij}^{(1)}, y_{ij}^{(1)})$ in the focal plane 22 of the lens 20 and a feeding element $\mathbf{42}_{pq}$ of the second group 54 of feeding elements 42 that is positioned at a Cartesian co-ordinate position $P_{pq}^{(2)}=(x_{pq}^{(2)}, y_{pq}^{(2)})$ in the focal plane 22 of the lens 22 creates a virtual feeding element 62 that has a virtual position $Q_{ijpg}=\frac{1}{2}(x_{ij}^{(1)}+x_{ij}^{(2)}, y_{pq}^{(2)}+y_{pq}^{(2)})$.

The virtual feeding element 62 has a radiation pattern 66 extending from the virtual position 64, and is defined by superposition of radiation patterns of the simultaneously operating pair of feeding elements 42 of the first and second groups 52, 54.

Each of the plurality of different virtual feeding elements 62 produces an antenna beam from the lens 20, radiation pattern 66, in a different specific direction θ defined by a virtual position 64 of the virtual feeding element 62.

Each of the simultaneously operational feeding elements 42 of the first and second groups 52, 54 is configured to produce a highly directive, narrow beam radiation pattern at frequencies above 24 GHz. The superposition of those radiation patterns 46 produces a highly directive, narrow beam radiation pattern 66 of the virtual feeding element 62.

Figure 6:
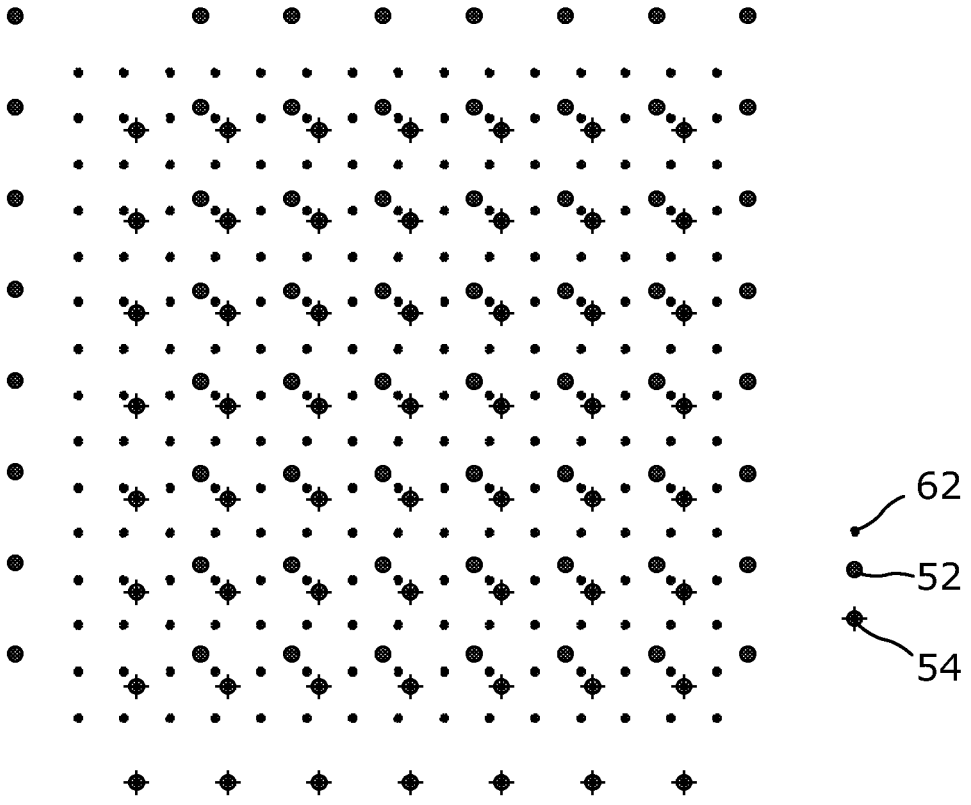
FIG. 6 shows another example embodiment of the subject matter described herein.

Two examples of groups 52, 54 of feeding elements 42 are illustrated in FIG. 2 and in FIG. 6.

The feeding elements 42 of the first group 52 are arranged in a different pattern to the feeding elements 42 of the second group 54. The feeding elements 42 of the first group 52 are arranged in a first pattern and the feeding elements 42 of the second group 54 are arranged in a second pattern, different to the first pattern.

In FIG. 2, the feeding elements 42 of the first group 52 do have even spatial distribution within the first pattern and the feeding elements 42 of the second group 54 do have even spatial distribution within the second pattern. The feeding elements 42 do not have the same spatial distribution within the first pattern and within the second pattern.

In FIG. 6, the feeding elements 42 do not have even spatial distribution within the first pattern. The feeding elements 42 do not have the same spatial distribution within the first pattern and within the second pattern.

In other examples (not illustrated), the feeding elements 42 do not have even spatial distribution within the first pattern and the feeding elements 42 do not have even spatial distribution within the second pattern. The feeding elements 42 do not have the same spatial distribution within the first pattern and within the second pattern.

FIG. 2 illustrates eight feeding elements 42 arranged in two groups of four feeding elements. Each group of four feeding elements is arranged in a square. The square of feeding elements 42 forming the first group 52 is larger than the square of feeding elements 42 forming the second group 54. The square of feeding elements 42 forming the first group 52 has a common center with the square of feeding elements 42 forming the second group 54. The sixteen different pairings of two groups of 4 feeding elements creates 16 virtual feeding elements 62 arranged in a regular 4×4 matrix.

The arrangement illustrated in FIG. 2 is therefore able to create 16 evenly spaced virtual feeding elements 62 using only eight feeding elements 42 arranged in two groups 52, 54 of four feeding elements 42.

FIG. 6 illustrates 120 feeding elements 42 arranged as sixty-four feeding elements 42 in the first group 52 and fifty-six feeding elements 42 in the second group 54. There are 225 different pairings of a feeding element 42 from the first group 52 and a feeding element 42 from the second group 54 that creates two hundred and twenty-five virtual feeding elements 62 arranged in a regular 15×15 matrix.

The arrangement illustrated in FIG. 6 is therefore able to create the two-hundred and twenty-five virtual feeding elements 62 using only one hundred and twenty feeding elements 42 arranged in two groups 52, 54 of sixty-four and fifty-six feeding elements 42 respectively.

The pattern of feeding elements 42 for the first group 52 and the pattern of feeding elements for the second group 54 required to produce a desired pattern of virtual feeding elements 62 can be determined, for example, using an algorithm.

Let the first group 52 of feeding elements 42 have positions $P_{ij}^{(1)}=(x_{ij}^{(1)}, y_{ij}^{(1)})$, the second group 54 of feeding elements 42 have positions $P_{pq}^{(2)}=(x_{pq}^{(2)}, y_{pq}^{(2)})$ and the virtual feeding elements 62 have positions $Q_{ijpg}=1/2\,(x_{ij}^{(1)}+y_{pq}^{(2)}+y_{pq}^{(2)})$ for some subset of i, j and p,q.

In order to determine optimal or near-optimal sets of positions $\{P_{ij}^{(1)}\}$ and $\{P_{pq}^{(2)}\}$ that provide virtual feeding elements 62 at corresponding positions $\{Q_{ijpg}\}$, we solve the following mathematical problem: given a set of virtual positions $\{Q_{ijpg}\}$, determine two minimal sets of positions $\{P_{ij}^{(1)}\}$ and $\{P_{pq}^{(2)}\}$ such that each virtual position $Q_{ijpg}$, can be expressed as $(P_{ij}^{(1)}+P_{pq}^{(2)}/2$ (i.e. $\frac{1}{2}(x_{ij}^{(1)}+x_{ij}^{(2)}, y_{pq}^{(2)}+y_{pq}^{(2)})$) for some i, j, p, q.

If n is the number of virtual positions in the set $\{Q_{ijpg}\}$, we can start with the number of positions $n^{(1)}$ in the set $\{P_{ij}^{(1)}\}$ made equal to n and then make the $n^{(2)}$ positions in the set $\{P_{pq}^{(2)}\}$ be their symmetric images with respect to the n positions in the set $\{Q_{ijpg}\}$ using $Q_{ijpg}=\frac{1}{2}(x_{ij}^{(1)}+x_{ij}^{(2)}, y_{pq}^{(2)}+y_{pq}^{(2)})$.

While the number of virtual positions n and the actual virtual positions $\{Q_{ijpg}\}$ are fixed, the number $n^{(1)}$ of feeding elements 42 in the first group 52, the positions $\{P_{ij}^{(1)}\}$ of the $n^{(1)}$ feeding elements 42 in the first group 52, the number $n^{(2)}$ of feeding elements 42 in the second group 54, the positions $\{P_{pq}^{(2)}\}$ of the $n^{(2)}$ feeding elements 42 in the second group 54, are variables that can be optimised.

The variables $n^{(1)}$, $n^{(2)}$, $\{P_{ij}^{(1)}\}$ and $\{P_{pq}^{(2)}\}$ can be determined that minimize a suitably defined cost function C.

The cost function C can, for example, be designed to decrease in value as the total accumulated distance between the position pairs $P_{ij}^{(1)}$ and $P_{pq}^{(2)}$ associated with the position $Q_{i'j'p'q'}$, for all $Q_{ijpq}$, decreases and to increase in value as the total accumulated distance between the position pairs $P_{ij}^{(1)}$ and $P_{pq}^{(2)}$ associated with the position $Q_{i'j'p'q'}$, for all $Q_{ijpq}$, increases.

For example, let the set α be the set {i, j} that defines $n^{(1)}$ feeding elements 42 in the first group 52, let the set β be the set {p, q} that defines $n^{(2)}$ feeding elements 42 in the second group 54, let γ represent the different pairings of elements of the sets α, β used to define the n virtual feeding elements 62, then the total accumulated distance D between the position pairs $P_{ij}^{(1)}$ and $P_{pq}^{(2)}$ is:

$$\Sigma_\gamma |P_\alpha^{(1)}-P_\beta^{(2)}|$$

or $$\Sigma_\gamma (P_\alpha^{(1)}-P_\beta^{(2)})^2$$

The cost function is constrained by $$\frac{\partial C}{\partial D} > 0$$

The cost function can be designed to decrease in value as a measure of area overlap between the first and second groups 52, 54 increases and/or the extent of non-overlap decreases.

Changing positions $\{P_{ij}^{(1)}\}$ so as to cause the set of positions $\{P_{ij}^{(1)}\}$ and the set of positions $\{P_{pq}^{(2)}\}$ to overlap, reduces the necessary numbers $n^{(1)}$, $n^{(2)}$ of feeding elements at positions $P_{ij}^{(1)}$ and $P_{pq}^{(2)}$.

The cost function can be designed to decrease in value as $n^{(1)}+n^{(2)}$ decreases.

The optimization of the cost function C can be constrained.

For example, the distances between nearest neighbour positions $p_{ij}^{(1)}$ should not be less that a threshold T1 and not be more than a threshold T2. In some but not necessarily all examples the threshold T1 can be λ the target wavelength of operation. In some but not necessarily all examples the threshold T1 can be λ/2.

For example, the distances between nearest neighbour positions $P_{pq}^{(2)}$ should not be less than a threshold T1 and not be more than a threshold T2. In some but not necessarily all examples the threshold T1 can be λ the target wavelength of operation. In some but not necessarily all examples the threshold T1 can be λ/2.

For example, the distances between the position $p_{i'j'}^{(1)}$ and $P_{p'q'}^{(2)}$ associated with the position $Q_{i'j'p'q'}$ should not be more than a threshold T3.

The optimization or constrained optimization can be performed by any suitable method.

For, example, a gradient based method, such as gradient descent for example, can use C and ∇C.

Figure 7:
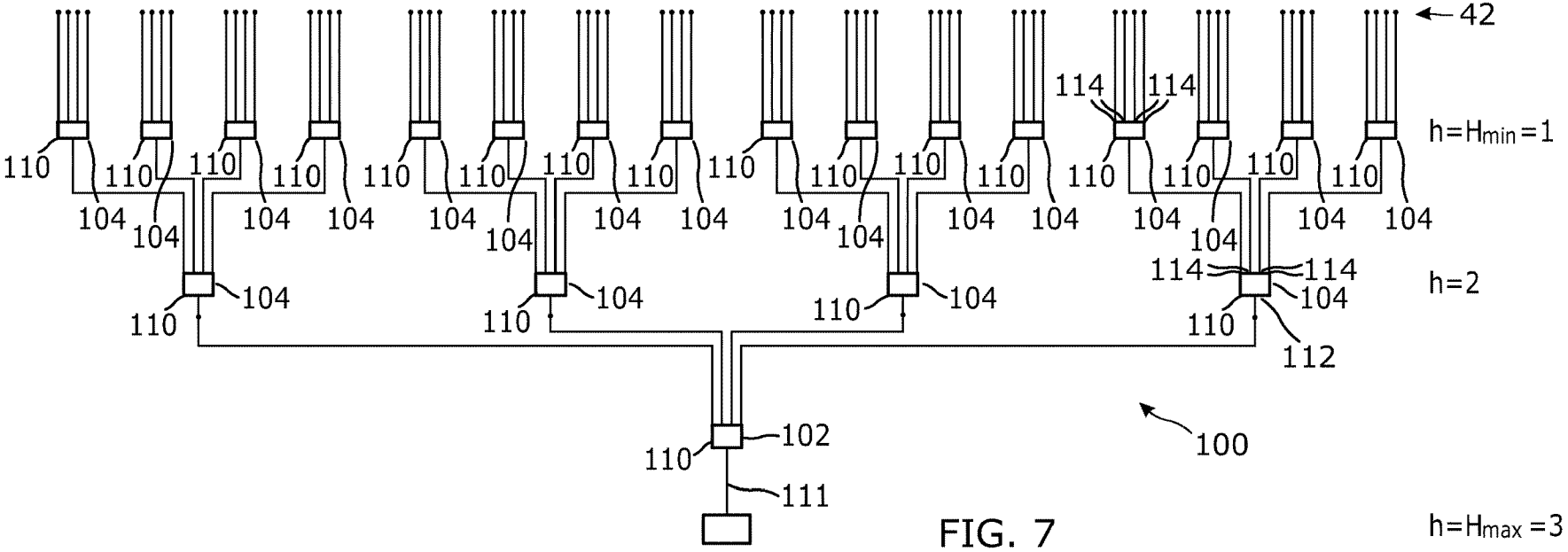
FIG. 7 shows another example embodiment of the subject matter described herein.

FIG. 7 illustrates an example of a switching network 100, that can be used as a first switching network $\mathbf{100}_1$ or a second switching network $\mathbf{100}_2$. The switching network 100 has a rooted tree architecture comprising, at a root 102 and at each other vertex 104 of the rooted tree, a single-pole multiple terminal switch 110.

Each of the single-pole multiple terminal switches 110 has the same number of M terminals 114.

The rooted tree architecture has H hierarchical levels including the highest hierarchical level Hmax and the lowest hierarchical level Hmin. Each of the first plurality of single-pole multiple terminal switches 110 has M terminals 114. The total number of switches 110 is $(M^H-1)/M-1$. The lowest hierarchy of $M^{H-1}$ single-pole multiple terminal switches 110 provides $M^H$ terminals 114 for operating up to $M^H$ feeding elements 42.

Each single-pole multiple terminal switch 110 is selectively controlled to connect its pole to one of its terminals. It is therefore possible to operate a particular feeding element 42 by controlling each single-pole multiple terminal switches 110 in the path from that particular feeding element 42 to the root 102.

In the example illustrated, M=4 and H=3. There are (4^3-1)/3=63/3=21 single-pole multiple terminal switches 110. The lowest hierarchy Hmin has 4^2=16 single-pole multiple terminal switches 110 and provides 4^3=64 terminals for operating up to 4^3=64 feeding elements 42.

Each single-pole multiple terminal switch 110, in a lowest hierarchical level (e.g. h=Hmin=1), has:

i) a single-pole 112 connected to only one terminal 114 of one single-pole multiple terminal switch 110 in the next higher hierarchical level and ii) each terminal 114 connected to only one feeding element 42 of the particular group 52, 54 of feeding elements 42 controlled by this switching network 100. Each feeding element 42 of the group 52, 54 of feeding elements 42 is connected to only one terminal 114 of a single-pole multiple terminal switch 110.

Each single-pole multiple terminal switch 110, in other hierarchical levels than the lowest hierarchical level and the highest hierarchical level at the root, has:

a single-pole 112 connected to only one terminal 114 of one single-pole multiple terminal switch 110 in the next higher hierarchical level (e.g. h=2).

The highest hierarchical level (e.g. h=Hmax=3) at the root 102 of the rooted tree architecture, comprises a single-pole multiple terminal switch 110 that has:

i) each of its terminals 114 connected to only one single pole 112 of one single-pole multiple terminal switch 110 in the next lower hierarchical level (Hmax−1) and ii) has its single-pole 112 connected to transfer an information signal 111.

The information signal 111 can be a received signal that is transferred from the single pole 112 at the root 102 to receiver circuitry 120.

The information signal can be a transmitted signal that is transferred to the single pole 112 at the root 102 from transmitter circuitry 120.

The information signal can be a received signal that is transferred from the single pole 112 at the root 102 to a receiver part of transceiver circuitry 120.

The information signal can be a transmitted signal that is transferred to the single pole 112 at the root 102 from a transmitter part of transceiver circuitry 120.

The receiver circuitry 120 and the receiver part of transceiver circuitry 120, can be collectively referred to as receiving circuitry 120. The transmitter circuitry 120 and the transmitter part of transceiver circuitry 120, can be collectively referred to as transmitting circuitry 120.

Figure 8:
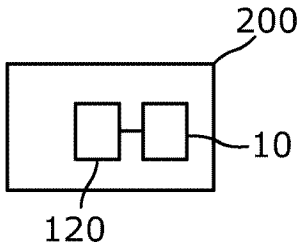
FIG. 8 shows another example embodiment of the subject matter described herein.

FIG. 8 illustrates an example of a radio communication apparatus 200. The radio communication apparatus 200 comprises the apparatus 10 and transmitting and/or receiving circuitry 120.

The radio communication apparatus 200 in some but not necessarily all examples is configured to produce different directed, highly directive, narrow beam radiation patterns at frequencies above 24 GHz.

The RF circuitry part 120 and/or the controller circuitry 60 can in some embodiments be disposed separately from the antenna parts 40, 20. For example, some, all or none of the circuitry parts 60, 120 can be encased in a radio equipment box which is physically separate from the antenna part 40, 20 and only has power and/or RF connections (electrical/optical cables) connecting the radio equipment box to the antenna part 40,20. While the antenna part 40, 20 is most likely to be positioned externally of the box, in some examples the antenna part 40, 20 can be internal to the box which is then configured to allow RF electromagnetic waves in or out of the box without too much RF loss.

Although in the preceding examples, the circuitry 60 is configured to simultaneously operate only one feeding element 42 of a first group 52 of feeding elements and only one feeding element 42 of a second group 54 of feeding elements, in other examples the circuitry 60 is configured to simultaneously operate one or more feeding elements 42 of the first group 52 of feeding elements and one or more feeding elements 42 of the second group 54 of feeding elements.

Although in the preceding examples, the circuitry 60 is configured to simultaneously operate one feeding element 42 of a first group 52 of feeding elements and one feeding element 42 of a second group 54 of feeding elements, in other examples the circuitry 60 is configured to simultaneously operate one or more feeding element 42 of the first group 52 of feeding elements and one or more feeding elements 42 of the second group 54 of feeding elements and one or more feeding element 42 of a third group of feeding elements.

The feeding elements 42 described may be configured to operate in one or more operational resonant frequency bands. For example, the operational frequency bands may include (but are not limited to) Long Term Evolution (LTE) (US) (734 to 746 MHz and 869 to 894 MHz), Long Term Evolution (LTE) (rest of the world) (791 to 821 MHz and 925 to 960 MHz); Bluetooth (2400-2483.5 MHz); wireless local area network (WLAN) (2400-2483.5 MHz); hiper local area network (HiperLAN) (5150-5850 MHz); global positioning system (GPS) (1570.42-1580.42 MHz); US—Global system for mobile communications (US-GSM) 850 (824-894 MHz) and 1900 (1850-1990 MHz); European global system for mobile communications (EGSM) 900 (880-960 MHz) and 1800 (1710-1880 MHz); European wideband code division multiple access (EU-WCDMA) 900 (880-960 MHz); personal communications network (PCN/DCS) 1800 (1710-1880 MHz); US wideband code division multiple access (US-WCDMA) 1700 (transmit: 1710 to 1755 MHz, receive: 2110 to 2155 MHz) and 1900 (1850-1990 MHz); wideband code division multiple access (WCDMA) 2100 (transmit: 1920-1980 MHz, receive: 2110-2180 MHz); personal communications service (PCS) 1900 (1850-1990 MHz); time division synchronous code division multiple access (TD-SCDMA) (1900 MHz to 1920 MHz, 2010 MHz to 2025 MHz), ultra wideband (UWB) Lower (3100-4900 MHz); UWB Upper (6000-10600 MHz); digital video broadcasting-handheld (DVB-H) (470-702 MHz); DVB-H US (1670-1675 MHz); worldwide interoperability for microwave access (WiMax) (2300-2400 MHz, 2305-2360 MHz, 2496-2690 MHz, 3300-3400 MHz, 3400-3800 MHz, 5250-5875 MHz); radio frequency identification ultra high frequency (RFID UHF) (433 MHz, 865-956 MHz, 2450 MHz); frequency allocations for 5G may include e.g. 700 MHz, 3.6-3.8 GHz, 24.25-27.5 GHz, 31.8-33.4 GHz, 37.45-43.5, 66-71 GHz, mmWave, and >24 GHz).

A frequency band over which a feeding element 42 can efficiently operate is a frequency range where the feeding element's return loss is less than an operational threshold.

As used in this application, the term 'circuitry' may refer to one or more or all of the following:

(a) hardware-only circuitry implementations (such as implementations in only analog and/or digital circuitry) and (b) combinations of hardware circuits and software, such as (as applicable):

(i) a combination of analog and/or digital hardware circuit (s) with software/firmware and (ii) any portions of hardware processor(s) with software (including digital signal processor(s)), software, and memory(ies) that work together to cause an apparatus, such as a mobile phone or server, to perform various functions and (c) hardware circuit(s) and or processor(s), such as a microprocessor(s) or a portion of a microprocessor(s), that requires software (e.g. firmware) for operation, but the software may not be present when it is not needed for operation.

This definition of circuitry applies to all uses of this term in this application, including in any claims. As a further example, as used in this application, the term circuitry also covers an implementation of merely a hardware circuit or processor and its (or their) accompanying software and/or firmware. The term circuitry also covers, for example and if applicable to the particular claim element, a baseband integrated circuit for a mobile device or a similar integrated circuit in a server, a cellular network device, or other computing or network device.

Components indicated or described as connected can be operationally coupled and any number or combination of intervening elements can exist (including no intervening elements)

Where a structural feature has been described, it may be replaced by means for performing one or more of the functions of the structural feature whether that function or those functions are explicitly or implicitly described.

As used here 'module' refers to a unit or apparatus that excludes certain parts/components that would be added by an end manufacturer or a user. The apparatus 10 can be a module.

The above described examples find application as enabling components of:

automotive systems; telecommunication systems; electronic systems including consumer electronic products; distributed computing systems; media systems for generating or rendering media content including audio, visual and audio visual content and mixed, mediated, virtual and/or augmented reality; personal systems including personal health systems or personal fitness systems; navigation systems; user interfaces also known as human machine interfaces; networks including cellular, non-cellular, and optical networks; ad-hoc networks; the internet; the internet of things; virtualized networks; and related software and services.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one." or by using "consisting".

In this description, reference has been made to various examples. The description of features or functions in relation to an example indicates that those features or functions are present in that example. The use of the term 'example' or 'for example' or 'can' or 'may' in the text denotes, whether explicitly stated or not, that such features or functions are present in at least the described example, whether described as an example or not, and that they can be, but are not necessarily, present in some of or all other examples. Thus 'example', 'for example', 'can' or 'may' refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example as part of a working combination but does not necessarily have to be used in that other example.

Although embodiments have been described in the preceding paragraphs with reference to various examples, it should be appreciated that modifications to the examples given can be made without departing from the scope of the claims.

Features described in the preceding description may be used in combinations other than the combinations explicitly described above.

Although functions have been described with reference to certain features, those functions may be performable by other features whether described or not.

Although features have been described with reference to certain embodiments, those features may also be present in other embodiments whether described or not.

The term 'a' or 'the' is used in this document with an inclusive not an exclusive meaning.

That is any reference to X comprising a/the Y indicates that X may comprise only one Y or may comprise more than one Y unless the context clearly indicates the contrary. If it is intended to use 'a' or 'the' with an exclusive meaning then it will be made clear in the context. In some circumstances the use of 'at least one' or 'one or more' may be used to emphasis an inclusive meaning but the absence of these terms should not be taken to infer and exclusive meaning.

The presence of a feature (or combination of features) in a claim is a reference to that feature or (combination of features) itself and also to features that achieve substantially the same technical effect (equivalent features). The equivalent features include, for example, features that are variants and achieve substantially the same result in substantially the same way. The equivalent features include, for example, features that perform substantially the same function, in substantially the same way to achieve substantially the same result.

In this description, reference has been made to various examples using adjectives or adjectival phrases to describe characteristics of the examples. Such a description of a characteristic in relation to an example indicates that the characteristic is present in some examples exactly as described and is present in other examples substantially as described.

Whilst endeavoring in the foregoing specification to draw attention to those features believed to be of importance it should be understood that the Applicant may seek protection via the claims in respect of any patentable feature or combination of features hereinbefore referred to and/or shown in the drawings whether or not emphasis has been placed thereon.

That which is claimed is:

1. An apparatus comprising:

a dielectric lens;

a feeding array comprising feeding elements at different positions; and circuitry configured to simultaneously operate a pair of feeding elements comprising (i) one feeding element of a first group of feeding elements and (ii) one feeding element of a second group of feeding elements, wherein any feeding element from the first group of feeding elements and any feeding element from the second group of feeding elements can be paired to constitute the pair of feeding elements, and wherein a number and positions of the feeding elements of the first and second groups are defined based at least in part upon a cost function that is dependent upon an area of overlap between positions of the first group of feeding elements and positions of the second group of feeding elements, wherein simultaneous operation of the one feeding element of the first group of feeding elements and the one feeding element of the second group of feeding elements creates one of a plurality of different virtual feeding elements, each having a different virtual position, and wherein there are more of the different virtual feeding elements than the feeding elements of either the first group or the second group.

2. An apparatus as claimed in claim 1, wherein the feeding elements in the first group are arranged as a two-dimensional array in a focal plane of the lens and wherein the feeding elements of the second group are arranged as a two-dimensional array in the focal plane of the lens.

3. An apparatus as claimed in claim 1, wherein each of the plurality of different virtual feeding elements produces an antenna beam in a different specific direction defined by a virtual position of a respective virtual feeding element.

4. An apparatus as claimed in claim 3, wherein the dielectric lens has a focal length F and wherein a virtual feeding element or feeding element at a Cartesian co-ordinate position (X, Y) in a focal plane of the lens orients the antenna beam to an angle $\sin^{1}(X/F)$ relative to the x-axis and to an angle $\sin^{-1}(Y/F)$ relative to the y-axis.

5. An apparatus as claimed in claim 1, wherein simultaneous operation of a feeding element of the first group of feeding elements that is positioned at a Cartesian co-ordinate position (X1, Y1) in a focal plane of the lens and a feeding element of the second group of feeding elements that is positioned at a Cartesian co-ordinate position (X2, Y2) in the focal plane of the lens creates a virtual feeding element that is positioned at ½(X1+X2, Y1+Y2).

6. An apparatus as claimed in claim 1, wherein the dielectric lens is shaped to equalize a phase front of an incident field radiated by any one of the plurality of virtual feeding elements.

7. An apparatus as claimed in claim 1, wherein the feeding elements in the first group are arranged in a different pattern to the feeding elements of the second group.

8. An apparatus as claimed in claim 7, wherein the feeding elements in the first group are arranged in a first pattern and the feeding elements of the second group are arranged in a second pattern, wherein the feeding elements do not have even spatial distribution within the first pattern and/or the second pattern and/or the feeding elements do not have the same spatial distribution within the first pattern and within the second pattern.

9. An apparatus as claimed in claim 1, wherein the circuitry comprises a first switching network configured to independently select for operation of the at least one feeding element of the first group of feeding elements and a second switching network configured to independently select for operation of the at least one feeding element of the second group of feeding elements.

10. An apparatus as claimed in claim 9, wherein the first switching network has a rooted tree architecture comprising, at a root and at internal vertexes of the rooted tree, a first plurality of single-pole multiple terminal switches, wherein each single-pole multiple terminal switch, in a lowest hierarchical level, has a single-pole connected to only one terminal of one single-pole multiple terminal switch in the next higher hierarchical level and each terminal connected to only one feeding element of the first group of feeding elements, wherein each feeding element of the first group of feeding elements is connected to only one terminal of a single-pole multiple terminal switch;

each single-pole multiple terminal switch, in other hierarchical levels than the lowest hierarchical level and the highest hierarchical level at the root, has a single-pole connected to only one terminal of one single-pole multiple terminal switch in the next higher hierarchical level; and the highest hierarchical level at the root of the rooted tree architecture, comprises a single-pole multiple terminal switch that has each of its terminals connected to only one single pole of one single-pole multiple terminal switch in the next lower hierarchical level and has its single-pole connected to transfer an information signal.

11. An apparatus as claimed in claim 10, wherein each of the first plurality of single-pole multiple terminal switches has the same number of terminals.

12. An apparatus as claimed in claim 11, wherein the rooted tree architecture has H hierarchical levels including the highest hierarchical level and the lowest hierarchical level, wherein each of the first plurality of single-pole multiple terminal switches has M terminals, wherein the first plurality is $(M^H-1)/M-1$ and the first group comprises $M^H$ feeding elements.

13. An apparatus as claimed in claim 1, wherein each feeding element is configured to produce a highly directive, narrow beam radiation pattern at frequencies above 24 GHz.

14. A radio communication apparatus comprising the apparatus as claimed in claim 1.

15. An apparatus as claimed in claim 1, wherein a spacing between nearest neighbors of the feeding elements of a respective one of the first or second groups is not less than a first threshold and not more than a second threshold.

16. An apparatus as claimed in claim 15, wherein the first threshold is $\lambda/2$ and the second threshold is $\lambda$.

17. An apparatus as claimed in claim 1, wherein locations of centers of the first and second groups of feeding elements are the same.

18. An apparatus as claimed in claim 1, wherein the cost function is configured to decrease in value as a measure of the area of overlap between positions of the first group of feeding elements and positions of the second group of feeding elements increases.

19. An apparatus as claimed in claim 1, wherein the cost function is configured to decrease in value as a total accumulated distance between position pairs of feeding elements of the first and second groups decreases and is configured to increase in value as the total accumulated distance between position pairs of feeding elements of the first and second groups increases, and wherein the total accumulated distance is based on a sum of a difference between the position pairs of feeding elements of the first and second groups.

20. An apparatus as claimed in claim 1, wherein the plurality of different virtual feeding elements comprises a number of different virtual feeding elements equivalent to a number of feeding elements of the first group of feeding elements, or a number of feeding elements of the second group of feeding elements, squared.

* * * * *